United States Patent [19]

Bosworth

[11] 4,392,321

[45] Jul. 12, 1983

[54] RIMMED CARTRIDGE MAGAZINE LOADER

[76] Inventor: Jack L. Bosworth, 5674 Kingship Loop, Columbus, Ohio 43229

[21] Appl. No.: 192,461

[22] Filed: Sep. 30, 1980

[51] Int. Cl.[3] ..... F42B 39/06

[52] U.S. Cl. ..... 42/87

[58] Field of Search ..... 42/87, 88; 221/303, 221/304, 306

[56] References Cited

U.S. PATENT DOCUMENTS

| | | | |
|---|---|---|---|
| 1,178,785 | 4/1916 | Debuchy | 42/87 |
| 2,981,024 | 4/1961 | Skoff | 42/87 |
| 3,004,692 | 10/1961 | Barton | 221/306 |
| 3,242,609 | 3/1966 | Koistinen | 42/87 |
| 3,628,273 | 12/1971 | Lach | 42/87 |

*Primary Examiner*—Charles T. Jordan

*Attorney, Agent, or Firm*—T. Gene Dillahunty

[57] ABSTRACT

A rifle cartridge magazine loader which allows loading rimmed cartridges in end-to-end orientation directly into a rifle or similar magazine in nose up, nose down or any other orientation necessitated by the design or configuration of the magazine. The loader has a slot formed by two elongated members or strips which retain or suspend the cartridges by the rims. A portion of the slot communicates with a reservoir for bulk storage of the cartridges from which the cartridges pass through the slot except for being retained or suspended by the rims. A portion of the slot is closed on the back in order to slidably retain the cartridges in the slot for discharge at the end of the slot.

6 Claims, 5 Drawing Figures

RIMMED CARTRIDGE MAGAZINE LOADER

BACKGROUND OF THE INVENTION

This invention provides a device which is simple, compact, portable and hand held for efficient and rapid loading of rimmed cartridges into rifle magazines. The age old problem of loading rifle tube type magazines is well recognized in the prior art, which is replete with various devices which attempt to solve the problem. U.S. Pat. No. 3,628,273 to Lach contains a detailed disclosure of column 1, lines 10–44 of the problem of hand loading rimmed cartridges into a rifle magazine one-by-one in proper nose to base, end-to-end orientation, which disclosure is incorporated herein by reference.

The prior art devices solve the above cartridge loading problem in various ways, but each leave something to be desired in terms of convenience, simplicity, versatility and, in general, practicality. The Lach device is complex and requires use in combination with separate loading tubes, which are used to actually load the rifle magazine. Loading tubes and the Lach device are not convenient for the hunter or marksman to carry. In addition, the Lach device and loading tubes are not practical for rapid loading of rifle magazines having side port entry for the cartridges as opposed to open end entry. U.S. Pat. Nos. 869,632 to Hockett; 1,178,785 to Debuchy; 1,405,508 to Endres; 2,981,024 to Skoff; and 3,242,609 to Koistinen are illustrative of various devices for loading rifle magazines. Almost all of these prior art devices require one-by-one hand loading of the cartridges into the device. Therefore, once the cartridges are discharged from the device into the rifle magazine, the hunter or marksman is again faced with the problem of loading the cartridges one by one into the device and/or the rifle magazine. Only Debuchy and Lach provide the potential of bulk loading and reloading of the device, but they lack the flexibility and simplicity desired for rapid reloading.

GENERAL DESCRIPTION OF THE INVENTION

This invention is a cartridge magazine loader device comprising a slot formed by two elongated members appropriately spaced whereby the bullet and body of a cartridge can pass through the slot, but the rim of the cartridge is retained by the elongated members. A portion of the slot communicates with a reservoir suitable for holding bulk cartridges in random orientation. The reservoir contains means for directing the cartridges into the slot, where the cartridges fall through the slot by gravity and are retained in the slot by the rims. A portion of the slot is closed on the back by means capable of retaining the cartridges in the slot by the rims but allowing the cartridges to slide freely along the slot. The slot has an opening at the end of the closed portion of the slot suitable for the discharge of the cartridges into a rifle magazine. The elongated members referred to as forming the slot need not be separate members but may merely be the edge of the larger members forming the bottom of the loader, which in turn form the slot. Moreover, such elongated members need not be one piece but may be segmented so long as they form a slot capable of slidably retaining the cartridges by the rims.

The magazine loader device of this invention can be made in any size to accommodate any size rimmed cartridge and is usable with any cartridge which has a rim of a diameter sufficiently greater than the diameter of the body to suspend the cartridge in the slot. The reservoir can be any desired size to hold the desired number of cartridges. However, generally the most useful and practical configuration of the loader will be the size which is easily hand held and portable in the pockets of hunters' jackets, vests or the like.

This cartridge magazine loader device is used by dumping rimmed cartridges into the reservoir in any orientation and closing the top on the reservoir to hold the cartridges in the reservoir. Some of the cartridges will fall through the slot immediately and others will fall through when the loader is lightly shaken or rolled in order to move the cartridges around in the reservoir. As the cartridges fall through the slot and are suspended by the rims, they are manually moved to the closed portion of the slot. When a desired number of cartridges are oriented and retained by the rims in the slot, they are normally discharged from the end of the slot into a rifle magazine. Since the loader can be inverted or placed in any position and the cartridges can be retained in the closed position of the slot, the cartridges can be loaded into a tube magazine, a butt end magazine or a side port magazine. All of these can be loaded with the cartridges nose up, nose down or horizontal. With the open end of the slot appropriately adapted, this loader can be used like a stripper clip or can be used to load stripper clips.

Optional aspects and adaptations of this loader device will be readily apparent. For example movable means, such as a cover or sleeve, can be used to close the slot, thus preventing cartridges from passing from the reservoir through the slot and retaining the bulk cartridges in the loader reservoir during transit or storage until ready for use. When the cover or sleeve is moved or removed then the cartridges can pass through and down the slot as described above. Such a cover or sleeve could adapt this loader to be suitable for use as the disposable container in which the manufacturer packages and sells cartridges to the retail market. The retail customer would simply remove the cover or sleeve when ready to use the cartridges, then use the loader to quickly load the cartridges into a magazine. This adaptation would eliminate the bulk transfer of cartridges from a retail container to the loader. Also, the elongated members forming the slot can be adjustable to allow a simple loader with a slot of variable width to handle different size cartridges at different times. A spring loaded follower can be used for discharging the cartridges from the end of the slot. The discharge end of the slot can be shaped, for example curved concave, to fit the particular magazine more precisely. The discharge end of the slot can have a movable means for closing the end of the slot to prevent cartridges from exiting the slot until the end is opened for the desired discharge of the cartridges.

In another optional form the loader can have the slot communicating with the entire length of the reservoir and the closed portion of the slot can extend from the end of the reservoir. In this form it may be convenient to make the closed portion of the slot detachable from the first part of the slot for more compact carrying and storage. Furthermore in this form multiple detachable closed slots may be used with the reservoir portion of the slot.

The other advantages and uses will also be readily apparent. This loader will handle all sizes and types of rimmed cartridges having the same body diameter without changing the width of the slot. This loader enables the repeated, quick reloading of rifle magazines, such as that of a .22 rifle, from bulk cartridge supply, which increases the effectiveness of such a rifle, particularly for defensive purposes. Before this invention the effectiveness of such rifles for defensive purposes was impaired by the time required to reload the magazine.

THE DRAWINGS

THE PREFERRED EMBODIMENT

Figure 1:
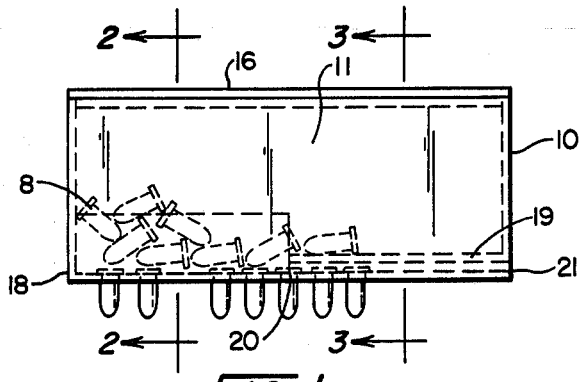
FIG. 1 is a side elevation view of the cartridge magazine loader.
Figure 2:
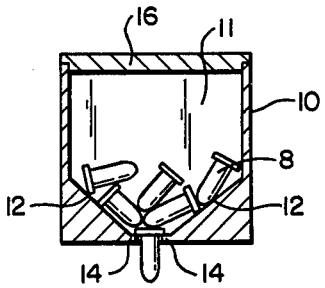
FIG. 2 is a vertical section view taken along line 2—2 of the portion of the loader in which the slot communicates with the reservoir.
Figure 4:
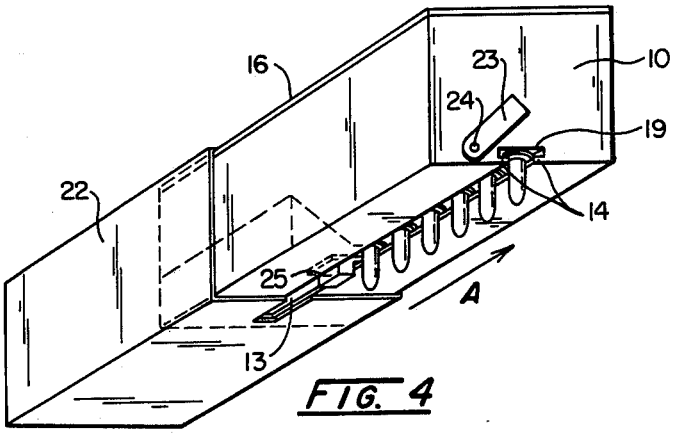
FIG. 4 and FIG. 5 are perspective views showing the loader in operation.
Figure 3:
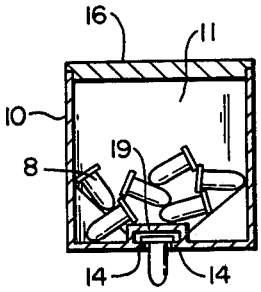
FIG. 3 is a vertical section view taken along line 3—3 of the portion of the loader in which the slot is closed on the back.
Figure 5:
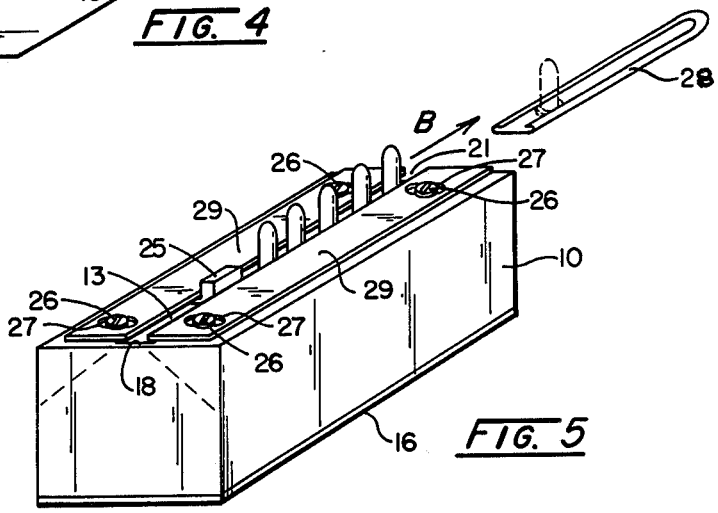

The preferred embodiment is described as follows by reference to the designated elements shown in the drawing. The cartridge magazine loader 10 comprises reservoir or chamber 11 for holding bulk, randomly oriented cartridges 8 and means 12 for directing the cartridges into slot 13 formed by elongated members 14. Slot 13 is closed at the reservoir end at point 18. The means for directing the cartridges into the slot can be curved, straight or any configuration and at any angle which is effective in directing the cartridges into slot 13. Cover 16 closes the reservoir to prevent the cartridges from falling out when the loader is used and inverted. Cover 19 closes the back of a portion of the slot and retains the cartridges in the slot when loader 10 is inverted. Cover 19 extends from point 20 to open end 21 where the cartridges are discharged. After the cartridges fall through slot 13 and are moved to the closed portion of the slot between point 20 and opening 21, the loader 10 can be inverted or positioned to discharge the cartridges in the directions shown by arrows A and B into a rifle magazine or into detachable slot 28.

Sleeve 22 slides over loader 10 to close slot 13 to prevent cartridges from passing from the reservoir through slot 13. Bar 23 rotates at pin 24 to close the opening at the end of slot 13. A follower 25 is used to discharge the cartridges from slot 13 at opening 21. Elongated members 29 mounted by screws 26 at slotted holes 27 can be adjusted to change the width of slot 13.

I claim:

1. A rimmed cartridge magazine loader comprising:

parallel elongated members forming a slot for slidably retaining cartridges by the rims thereof in the slot formed by said parallel members, a portion of said slot formed by said members communicating with a bulk cartridge reservoir which contains means for directing the cartridges into said slot whereby the body of the cartridge can pass from the reservoir through the slot and the rim of the cartridge is retained by said elongated members, a portion of said slot being closed on the back by means capable of slidably retaining the cartridges in the slot, said slot having an opening at the end of the closed portion of the slot suitable for discharge of the cartridges into a magazine.

2. The loader of claim 1 which further comprises movable means for preventing the cartridges from passing from the reservoir through the slot until ready for use.

3. The loader of claims 1 or 2 which further comprises movable means for closing the opening at the end of the closed portion of the slot.

4. The loader of claims 1 or 2 wherein the closed portion of the slot is detachable from the portion of the slot communicating with the reservoir.

5. The loader of claims 1 or 2 wherein the elongated members are adjustable providing a slot that can be varied in width.

6. The loader of claims 1 or 2 which further comprises a follower for discharging the cartridges from the opening at the end of the closed portion of the slot.

* * * * *